US009239054B2

(12) United States Patent
Ignatiev et al.

(10) Patent No.: US 9,239,054 B2
(45) Date of Patent: Jan. 19, 2016

(54) SCROLL COMPRESSOR WITH OIL-COOLED MOTOR

(71) Applicant: Emerson Climate Technologies, Inc., Sidney, OH (US)

(72) Inventors: Kirill M. Ignatiev, Sidney, OH (US); Ronald E. Bonear, Troy, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 160 days.

(21) Appl. No.: 14/063,056

(22) Filed: Oct. 25, 2013

(65) Prior Publication Data

US 2014/0140868 A1 May 22, 2014

Related U.S. Application Data

(60) Provisional application No. 61/728,329, filed on Nov. 20, 2012.

(51) Int. Cl.

| | |
|---|---|
| ***F04B 39/04*** | (2006.01) |
| ***F04C 29/04*** | (2006.01) |
| ***F04C 23/00*** | (2006.01) |
| ***F04C 18/02*** | (2006.01) |

(52) U.S. Cl.

CPC ..... *F04C 29/045* (2013.01); *F04C 18/0215* (2013.01); *F04C 23/008* (2013.01)

(58) Field of Classification Search

CPC ... F04C 29/045; F04C 18/0215; F04C 23/008
USPC ..... 417/228, 372, 373; 418/85; 310/52–54, 310/58

See application file for complete search history.

(56) References Cited

U.S. PATENT DOCUMENTS

| | | | | |
|---|---|---|---|---|
| 4,516,916 | A * | 5/1985 | English et al. | 417/368 |
| 5,222,874 | A * | 6/1993 | Unnewehr et al. | 417/372 |
| 6,257,840 | B1 * | 7/2001 | Ignatiev et al. | 417/310 |
| 6,616,415 | B1 * | 9/2003 | Renken | F04C 28/08 318/433 |
| 6,655,932 | B1 * | 12/2003 | Stinessen et al. | 417/423.1 |

(Continued)

FOREIGN PATENT DOCUMENTS

| | | | |
|---|---|---|---|
| EP | 1698783 | A1 | 9/2006 |
| JP | 2011012629 | A | 1/2011 |
| JP | 2011012633 | A | 1/2011 |

OTHER PUBLICATIONS

International Search Report regarding Application No. PCT/US2013/067476, mailed Feb. 11, 2014.

(Continued)

*Primary Examiner* — Charles Freay

(74) *Attorney, Agent, or Firm* — Harness, Dickey & Pierce, P.L.C.

(57) ABSTRACT

A compressor may include a shell, a compression mechanism, a motor, a pumping mechanism, and a heat exchanger. The shell may define an internal cavity and an oil sump. The compression mechanism is disposed the said shell. The motor is coupled to a driveshaft for selectively powering the compression mechanism. The pumping mechanism may be in fluid-pumping communication with the oil sump. The first heat exchanger may be disposed external from the shell and in fluid communication with the pumping mechanism. The first heat exchanger may cool the oil prior to returning the cooled oil to the internal cavity.

27 Claims, 9 Drawing Sheets

(56) References Cited

U.S. PATENT DOCUMENTS

| | | | | |
|---|---|---|---|---|
| 7,878,780 | B2 | 2/2011 | Bush et al. | |
| 8,133,043 | B2 | 3/2012 | Duppert | |
| 8,590,324 | B2 * | 11/2013 | Guo et al. | 62/84 |
| 2009/0087320 | A1 * | 4/2009 | Tanaka et al. | 417/228 |
| 2010/0028165 | A1 * | 2/2010 | Kameya et al. | 417/12 |
| 2012/0189472 | A1 * | 7/2012 | McDonald | 417/372 |

OTHER PUBLICATIONS

Written Opinion of the International Searching Authority regarding Application No. PCT/US2013/067476, mailed Feb. 11, 2014.

* cited by examiner

SCROLL COMPRESSOR WITH OIL-COOLED MOTOR

CROSS-REFERENCE TO RELATED APPLICATIONS

This application claims the benefit of U.S. Provisional Application No. 61/728,329, filed on Nov. 20, 2012. The entire disclosure of the above application is incorporated herein by reference.

FIELD

The present disclosure relates to a compressor, and more particularly to a compressor having an oil-cooled motor.

BACKGROUND

This section provides background information related to the present disclosure and is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid between the condenser and the evaporator. Efficient and reliable operation of the compressor is desirable to ensure that the cooling, refrigeration, or heat-pump system in which the compressor is incorporated is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a shell, a compression mechanism, a motor, a pumping mechanism, and a heat exchanger. The shell may define an internal cavity and an oil sump. The compression mechanism is disposed the said shell. The motor is coupled to a driveshaft for selectively powering the compression mechanism. The pumping mechanism may be in fluid-pumping communication with the oil sump. The first heat exchanger may be disposed external from the shell and in fluid communication with the pumping mechanism. The first heat exchanger may cool the oil prior to returning the cooled oil to the internal cavity.

In some embodiments, the compressor may include first and second conduits. The first conduit may be in fluid communication with the pumping mechanism at a first end and may be in fluid communication with the first heat exchanger at a second end. The second conduit may be in fluid communication with the first heat exchanger at a first end and in fluid communication with the internal cavity at a second end.

In some embodiments, the drive shaft may include a first end disposed proximate to the oil sump and a second end disposed proximate to the compression mechanism. The drive shaft may be operable to transport the oil from the oil sump to the second end.

In some embodiments, the compressor may include a counterweight fixed to the driveshaft proximate to the second end.

In some embodiments, the counterweight may be rotatably received within a counterweight cavity disposed within the internal cavity.

In some embodiments, the counterweight cavity may be at least partially formed in a main bearing housing.

In some embodiments, the counterweight may cooperate with the counterweight cavity to pump oil received from the oil sump to direct the oil into the first heat exchanger.

In some embodiments, the compressor may include a second heat exchanger in fluid communication with the counterweight cavity.

In some embodiments, the compressor may include an oil distribution member receiving oil from the first heat exchanger and distributing the cooled oil within the internal cavity.

In some embodiments, at least a portion of the cooled oil is directed toward the motor.

In some embodiments, the compression mechanism may include a non-orbiting scroll member in meshing engagement with an orbiting scroll member.

In some embodiments, the compressor may include a suction port fluidly coupled with the compression mechanism to fluidly isolate suction-pressure gas entering the compressor from the motor.

In some embodiments, the compressor may include a conduit in fluid communication with the suction port at a first end and in fluid communication with the first heat exchanger at a second end to inject oil into a flow of suction-pressure working fluid.

In some embodiments, the compressor may include a conduit in fluid communication with a discharge port at a first end and in fluid communication with the internal cavity at a second end to divert oil disposed within the discharge port to the oil sump.

In some embodiments, the compressor may include an oil separator operable to separate discharge-pressure gas from the oil. The separated oil may be delivered to the return line of the first heat exchanger via the conduit.

In some embodiments, the compressor may include a valve disposed on the conduit and operable to control an amount of oil directed to the return line of the first heat exchanger via the conduit.

In some embodiments, the first heat exchanger may be attached to the shell.

In some embodiments, the oil pump may be disposed within the oil sump.

In another form, the present disclosure provides a compressor that may include a shell, a compression mechanism, a motor, a suction port, a pumping mechanism, and a first heat exchanger. The shell may define a lubricant sump. The compression mechanism is disposed within the shell and may include a first member moving relative to a second member and forming a fluid pocket therebetween. The motor may be disposed within the shell and coupled to a driveshaft for selectively powering the compression mechanism. The suction port may be fluidly coupled with the fluid pocket of the compression mechanism to fluidly isolate suction-pressure gas entering the shell from the motor. The pumping mechanism may be in communication with the lubricant sump. The first heat exchanger may be in fluid communication with the pumping mechanism and the motor. The first heat exchanger may receive lubricant from the pumping mechanism, cool the lubricant, and supply the cooled lubricant to the motor.

In some embodiments, the compressor may include a conduit in fluid communication with the first heat exchanger at a first end and in fluid communication with the shell at a second end to return the cooled lubricant to the shell.

In some embodiments, the pumping mechanism may include a counterweight cavity disposed within the shell and a counterweight rotatable within the counterweight cavity. The counterweight may cooperate with the counterweight cavity to pump the lubricant into the first heat exchanger.

In some embodiments, the compressor may include a conduit in fluid communication with the suction port at a first end and in fluid communication with the first heat exchanger at a second end to inject oil into a flow of suction-pressure working fluid.

In some embodiments, the compressor may include a conduit in fluid communication with a discharge port at a first end and in fluid communication with the shell at a second end to divert lubricant disposed within the discharge port to the lubricant sump.

In some embodiments, the compressor may include an oil separator operable to separate discharge-pressure gas from the lubricant. The separated lubricant may be delivered to the shell via the conduit.

In some embodiments, the compressor may include a valve disposed on the conduit and operable to control an amount of lubricant directed to the shell via the conduit.

In some embodiments, the compressor may include a lubricant distribution member in fluid communication with the heat exchanger and operable to distribute the cooled lubricant within the shell.

In some embodiments, the distribution member may be an annular member including a plurality of lubricant drain apertures extending therethrough.

In some embodiments, the compressor may include a counterweight cavity formed within the shell. The drive shaft may be operable to deliver the lubricant to the counterweight cavity from the lubricant sump.

In some embodiments, the first heat exchanger may be attached to the shell.

In some embodiments, at least one of the first and second members of the compression mechanism includes a lubricant groove in fluid communication with the first heat exchanger. In some embodiments, the first and second members may be scroll members.

In some embodiments, the compressor may include a second heat exchanger receiving lubricant from the pumping mechanism, cooling the lubricant, and returning the cooled lubricant to the shell.

In yet another form, the present disclosure provides a method that may include pumping oil from an oil sump of within a compressor shell to a first heat exchanger disposed external to the compressor shell. Heat may be removed from the oil in the first heat exchanger. The oil may be directed from the first heat exchanger to a component within the compressor shell. Heat may be transferred from the component to the oil.

In some embodiments, pumping the oil may include operating a pumping mechanism at least partially disposed in the oil sump.

In some embodiments, pumping the oil may include rotating a counterweight within a counterweight cavity within the compressor shell.

In some embodiments, the method may include pumping oil from the oil sump to a second heat exchanger disposed external to the compressor shell.

In some embodiments, the method may include directing the cooled oil from the second heat exchanger to at least one of a compression mechanism within the compressor shell and a motor within the compressor shell.

In some embodiments, directing the oil from the first heat exchanger to the component may include directing the oil to at least one of a compression mechanism within the compressor shell and a motor within the compressor shell.

In some embodiments, the method may include distributing the oil from the first heat exchanger onto the motor.

In some embodiments, the method may include fluidly isolating suction-pressure gas entering the compressor shell from a motor within the compressor shell.

In some embodiments, the method may include directing oil disposed in a discharge conduit connected to the compressor shell to the oil sump.

In some embodiments, the directing the oil may include opening a valve to direct the oil towards the oil sump.

In some embodiments, the method may include passing a mixture of discharge-pressure gas and oil through an oil separator to separate the oil from the discharge-pressure gas prior to directing the separated oil to the oil sump.

In some embodiments, the method may include directing oil from the first heat exchanger to a suction conduit connected to the compressor shell.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
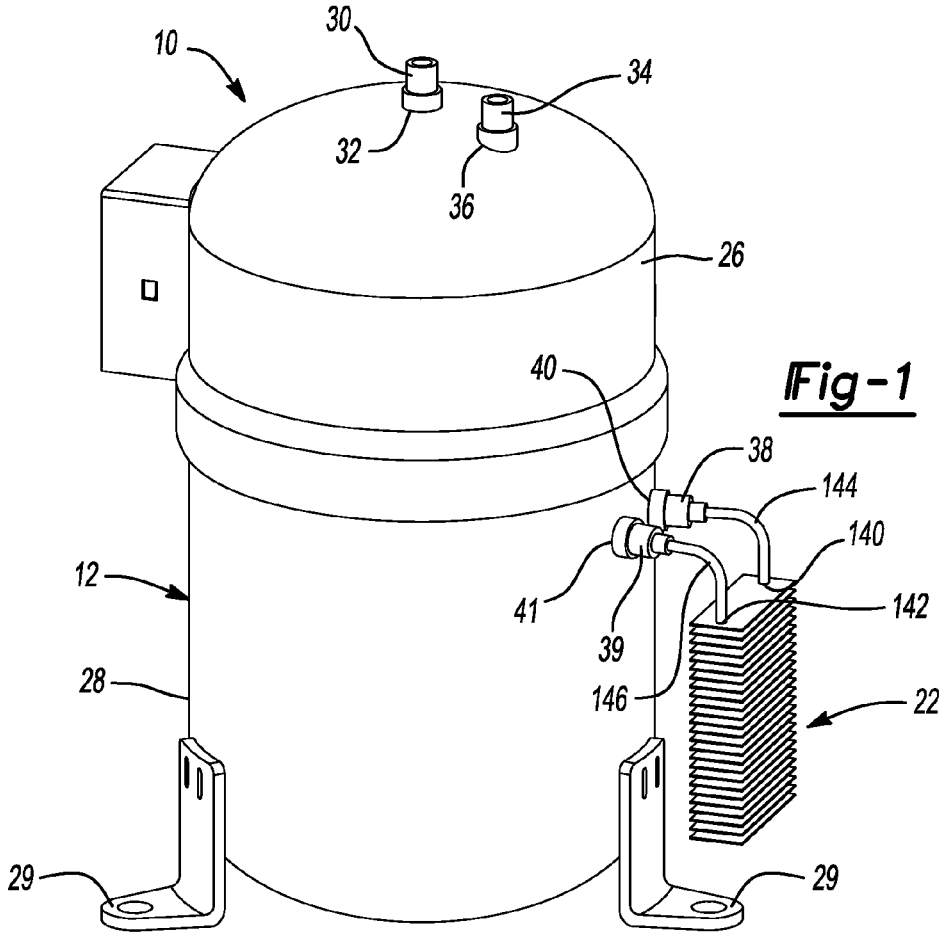
FIG. 1 is a perspective view of a compressor according to the principles of the present disclosure.
Figure 2:
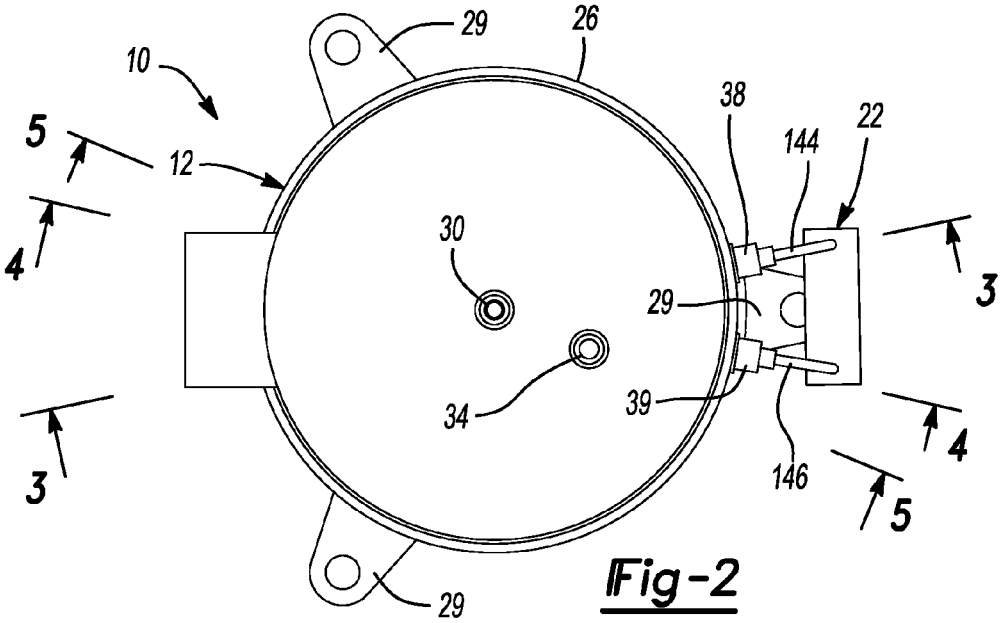
FIG. 2 is a plan view of the compressor of FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-8, a compressor 10 is provided and may include shell assembly 12, a bearing housing assembly 14, a motor assembly 16, a compression mechanism 18, an oil sump 20, a heat exchanger 22, and an oil distribution member 24. The shell assembly 12 defines an internal cavity housing the bearing housing assembly 14, the motor assembly 16, the compression mechanism 18, the oil sump 20, and the oil distribution member 24. The shell assembly 12 generally forms a compressor housing and may include an end cap 26 and a lower portion 28 having a base or a plurality of feet 29. A discharge fitting 30 may extend through the shell assembly 12 at a first opening 32 in the end cap 26. A suction fitting 34 may extend through the shell assembly 12 at a second opening 36 in the end cap 26. A first oil fitting 38 (FIGS. 1-3) may extend through the shell assembly 12 at a third opening 40 in the lower portion 28. A second oil fitting 39 (FIGS. 1, 2, and 4) may extend through the shell assembly 12 at a fourth opening 41 in the lower portion 28.

The bearing housing assembly 14 may include a thrust-bearing housing 42 and a main-bearing housing 44. The thrust-bearing housing 42 may be a generally annular member having an outer rim 46, an upper recessed portion 48, a lower recessed portion 50, and a central aperture 52. The outer rim 46 may include a plurality of apertures 54 (FIG. 6) extending therethrough such that each aperture extends along a length of the thrust-bearing housing 42. The upper recessed portion 48 may house an annular-thrust bearing 56 disposed radially outward relative to the central aperture 52 that applies a force on a portion of the compression mechanism 18.

The main-bearing housing 44 may be a generally annular member having an outer rim 58, an upper recessed portion 60, a lower recessed portion 62, and a main bearing 64. The outer rim 58 may abut the outer rim 46 of the thrust-bearing housing 42 and may include a plurality of apertures 66 (FIG. 6) corresponding to the plurality of apertures 54 of the outer rim 46 of the thrust-bearing housing 42. The upper recessed portion 60 of the main-bearing housing 44 and the lower recessed portion 50 of the thrust-bearing housing 42 may cooperate to define a counterweight cavity 68. A first passage 70 (FIG. 3) may extend through a portion of the outer rim 58 of the main-bearing housing 44 to the upper recessed portion 60 of the main-bearing housing 44. A second passage 72 (FIG. 4) may extend through a portion of the outer rim 58 of the main-bearing housing 44 to the lower recessed portion 62 of the main-bearing housing 44.

The motor assembly 16 may include a motor housing 74, a stator 76, and a rotor 78 that cooperate with a drive shaft 80 to selectively cause movement of the compression mechanism 18. The motor housing 74 may include a body portion 82, an internal cavity 84, and a lower, central aperture 86. The body portion 82 may engage the lower portion 28 of the shell assembly 12 and may be fixed thereto via a press-fit, welding, staking, and/or any other suitable means. The body portion 82 may abut the outer rim 58 of the main-bearing housing 44 and may include a plurality of threaded apertures 87 (FIG. 6) corresponding to the plurality of apertures 54, 66 of the thrust-bearing housing 42 and the main-bearing housing 44, respectively.

Figure 3:
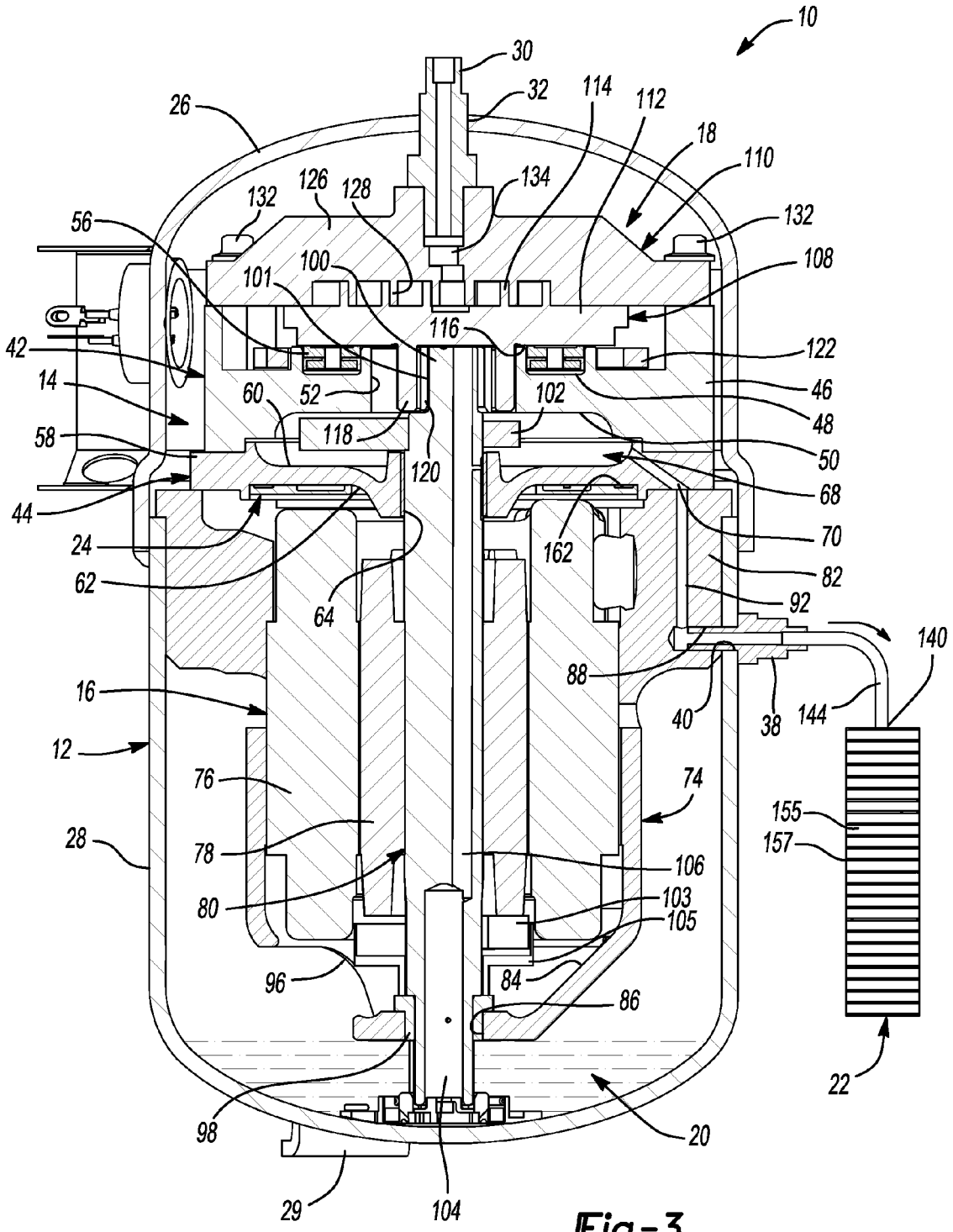
FIG. 3 is a cross-sectional view of the compressor of FIG. 1 taken along line 3-3.
Figure 4:
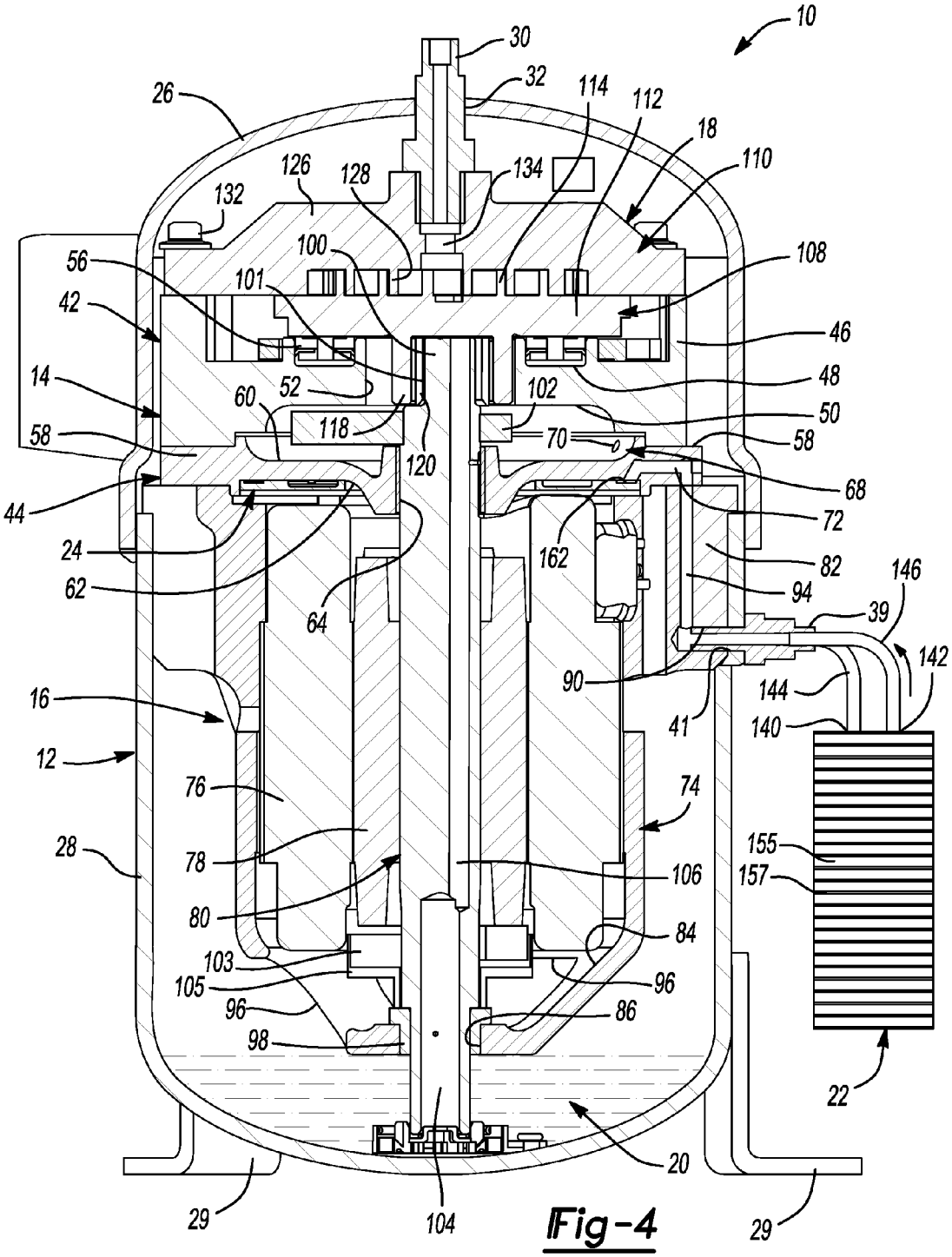
FIG. 4 is a cross-sectional view of the compressor of FIG. 1 taken along line 4-4.

The body portion 82 may also include a first aperture 88 (FIG. 3), a second aperture 90 (FIG. 4), a first passage 92 (FIG. 3), and a second passage 94 (FIG. 4). As shown in FIG. 3, the first aperture 88 may be in fluid communication with the first passage 92 and may be aligned with the third opening 40 in the shell assembly 12 to receive a portion of the first oil fitting 38. The first passage 92 of the body portion 82 may be in fluid communication with the first passage 70 of the main-bearing housing 44. In this manner, the first passage 92 may provide fluid communication between the first oil fitting 38 and the first passage 70. As shown in FIG. 4, the second aperture 90 may be in fluid communication with the second passage 94 and may be aligned with the fourth opening 41 in the shell assembly 12 to receive a portion of the second oil fitting 39. The second passage 94 of the body portion 82 may be in fluid communication with the second passage 72 of the main-bearing housing 44. In this manner, the second passage 94 may provide fluid communication between the second oil fitting 39 and the second passage 94.

The internal cavity 84 may house the stator 76, the rotor 78, and a portion of the drive shaft 80. The stator 76 may be press-fit into the internal cavity 84 or otherwise fixed therein while the rotor 78 may be press-fit onto the drive shaft 80 or otherwise fixed thereto. The internal cavity 84 may include one or more openings 96 in communication with the internal cavity of the shell assembly 12. The lower, central aperture 86 of the motor housing 74 may be disposed at a lower end of the internal cavity 84 and may house a lower bearing 98.

The drive shaft 80 is rotatably driven by the rotor 78 and may be rotatably supported by the main bearing 64 and the lower bearing 98 relative to the stator 76. The drive shaft 80 may include an eccentric-crank pin 100 having a flat 101 thereon. An upper counterweight 102 may be fixed to the drive shaft 80 at a location proximate to the crank pin 100 and a lower counterweight 103 may be fixed to the drive shaft 80 proximate to the lower bearing 98. The upper counterweight 102 rotates within the counterweight cavity 68 while the lower counterweight 103 rotates within a counterweight cover 105.

The drive shaft 80 may also include a relatively large diameter concentric bore 104 and a radially outwardly positioned smaller diameter eccentric bore 106 extending generally upwardly from the concentric bore 104 to the top of the drive shaft 80. The eccentric bore 106 may be substantially parallel to a longitudinal axis of the drive shaft 80 or angled relative to the longitudinal axis of the drive shaft 80. Regardless of the particular construction of the eccentric bore 106, the eccentric bore 106 is in fluid communication with the concentric bore 104.

The compression mechanism 18 may generally include an orbiting scroll member 108 and a non-orbiting scroll member 110. The orbiting scroll member 108 may include an end plate 112 having a spiral wrap 114 disposed on an upper surface thereof and an annular thrust surface 116 disposed on a lower surface. The thrust surface 116 may interface with the annular thrust bearing 56 in the upper recessed portion 48 of the thrust-bearing housing 42. A cylindrical hub 118 may project downwardly from the thrust surface 116 and may have a drive bushing 120 rotatively disposed therein. The drive bushing 120 may include an inner bore in which the crank pin 100 is drivingly disposed. The flat 101 may drivingly engage a flat surface (not shown) in a portion of the inner bore of the drive bushing 120 to provide a radially compliant driving arrangement. An Oldham coupling 122 may be keyed to the orbiting scroll member 108 and the non-orbiting scroll member 110 or the thrust-bearing housing 42 to prevent relative rotation between the orbiting and non-orbiting scroll members 108, 110 while allowing relative orbital motion between the orbiting and non-orbiting scroll members 108, 110.

The non-orbiting scroll member 110 may include an end plate 126 having a spiral wrap 128 on a lower surface thereof. The spiral wrap 128 may meshingly engage the spiral wrap 114 of the orbiting scroll member 108, thereby creating a series of moving fluid pockets between the scroll members 108, 110. The fluid pockets created by the spiral wraps 114, 128 may decrease in volume as they move from a radially outer position to a radially inner position throughout a compression cycle of the compression mechanism 18. A plurality of apertures 130 (FIG. 6) may extend through the end plate 126 and may correspond to the apertures 54, 66, 87 of the thrust-bearing housing 42, main-bearing housing 44, and motor housing 74, respectively. A plurality of bolts 132 may extend through the apertures 54, 66 and threadably engage apertures 87 of the motor housing 74.

Figure 5:
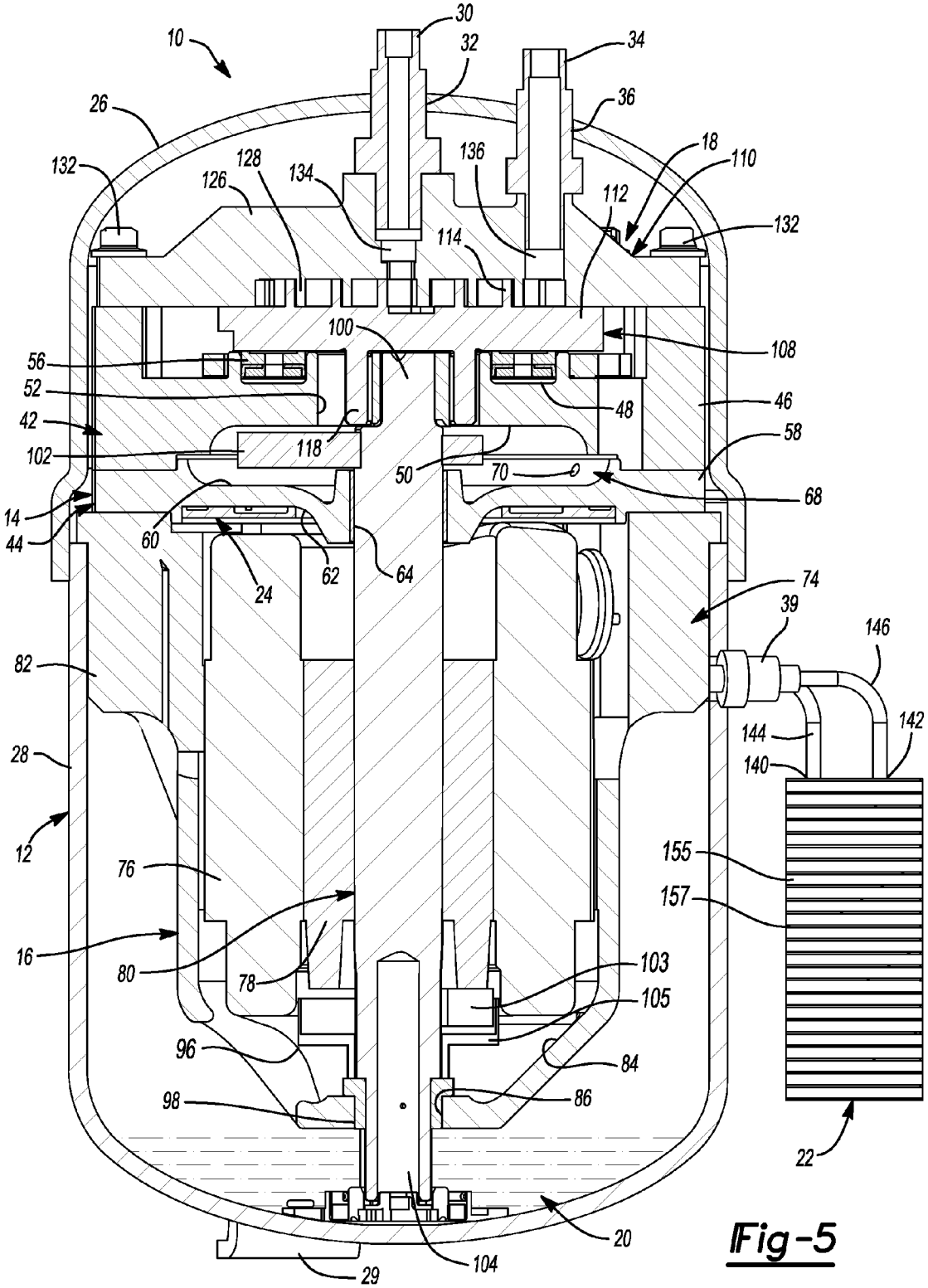
FIG. 5 is a cross-sectional view of the compressor of FIG. 1 taken along line 5-5.

A discharge passage 134 may extend axially through the end plate 126 and may be aligned with the first opening 32 in the shell assembly 12 for fluid communication with the discharge fitting 30. A suction passage 136 is shown in FIG. 5 extending axially through the end plate 126 substantially parallel to the discharge passage 134. While the discharge and suction passages 134, 136 are described above as extending in an axial direction, the discharge passage 134 and/or the suction passage 136 may extend in a radial direction.

The suction passage 136 may be in direct fluid communication with a radially outermost one of the series of moving pockets defined by the spiral wraps 114, 128 and may be aligned with the second opening 36 in the shell assembly 12. The suction fitting 34 is fluidly coupled with the suction passage 136 to allow suction gas entering the compressor 10 via the suction fitting 34 to be substantially fluidly isolated from the internal cavity of the shell assembly 12. While not specifically shown in the figures, the suction fitting 34 may include a relatively small orifice in fluid communication with the internal cavity of the shell assembly 12 that allows pressure equalization therebetween, while minimizing a volume of suction gas that is allowed to flow therethrough. Isolating a substantial portion of the suction gas entering the suction passage 136 from the heat of the internal cavity of the shell assembly 12 increases the volumetric efficiency of the compressor 10.

The oil sump 20 may be at least partially defined by the lower portion 28 of the shell assembly 12 and may be filled with a lubricant, such as oil or another fluid, to a predetermined level. The concentric bore 104 of the drive shaft 80 is in fluid communication with the oil sump 20 such that rotation of the drive shaft 80 pumps oil from the oil sump 20, through the concentric bore 104, along the eccentric bore 106, and to the compression mechanism 18 and various other components of the compressor 10 that require lubrication and cooling.

The heat exchanger 22 (shown schematically in the figures) may include a coiled fluid passage 155 and a plurality of fins 157 radiating heat to the ambient environment. The coiled fluid passage 155 may include an inlet 140 (FIGS. 1, 3, and 5) and an outlet 142 (FIGS. 1, 4, and 5). The inlet 140 may be in fluid communication with the first oil fitting 38 via a first conduit 144 while the outlet 142 may be in fluid communication with the second oil fitting 39 via a second conduit 146 (FIGS. 4 and 5).

Figure 6:
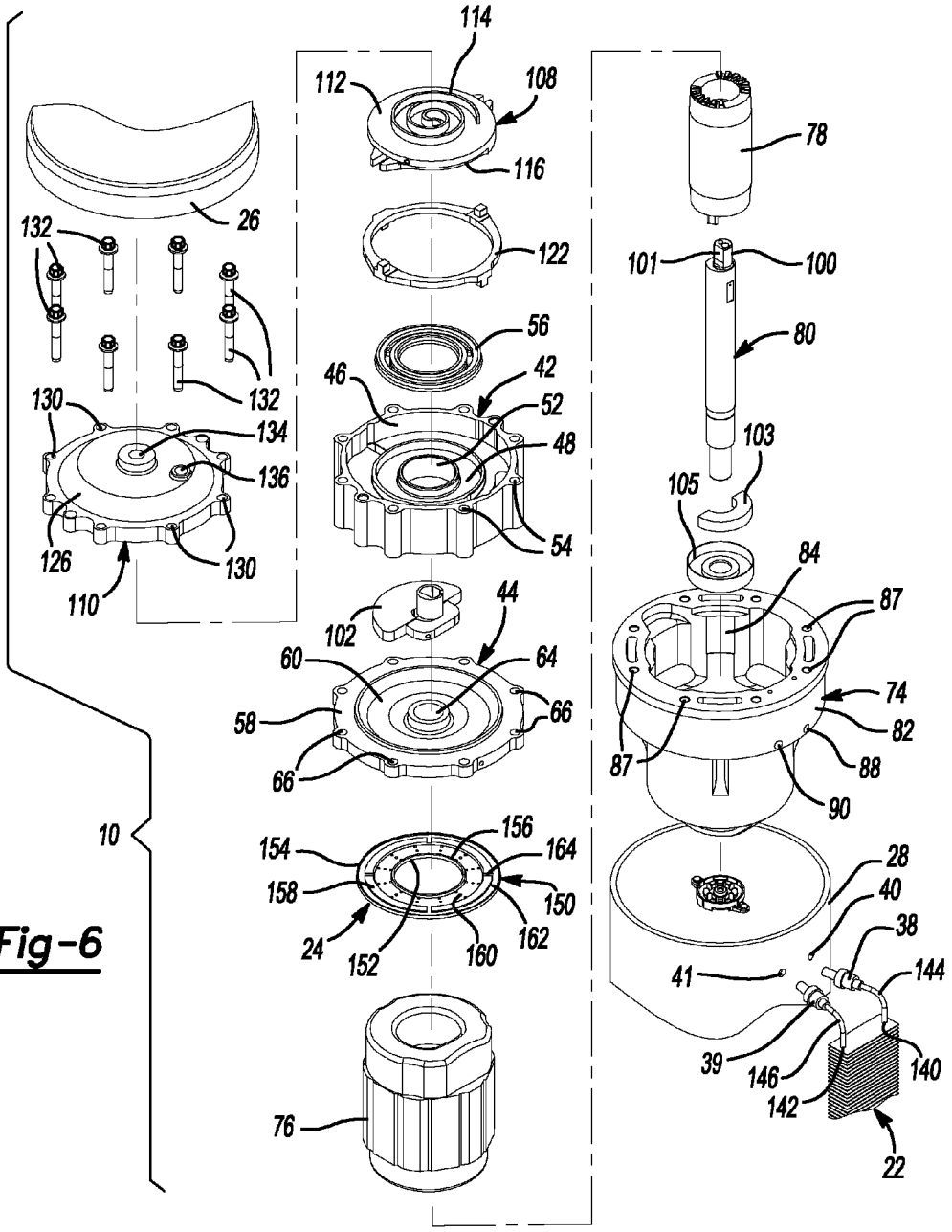
FIG. 6 is an exploded perspective view of the compressor of FIG. 1.
Figure 7:
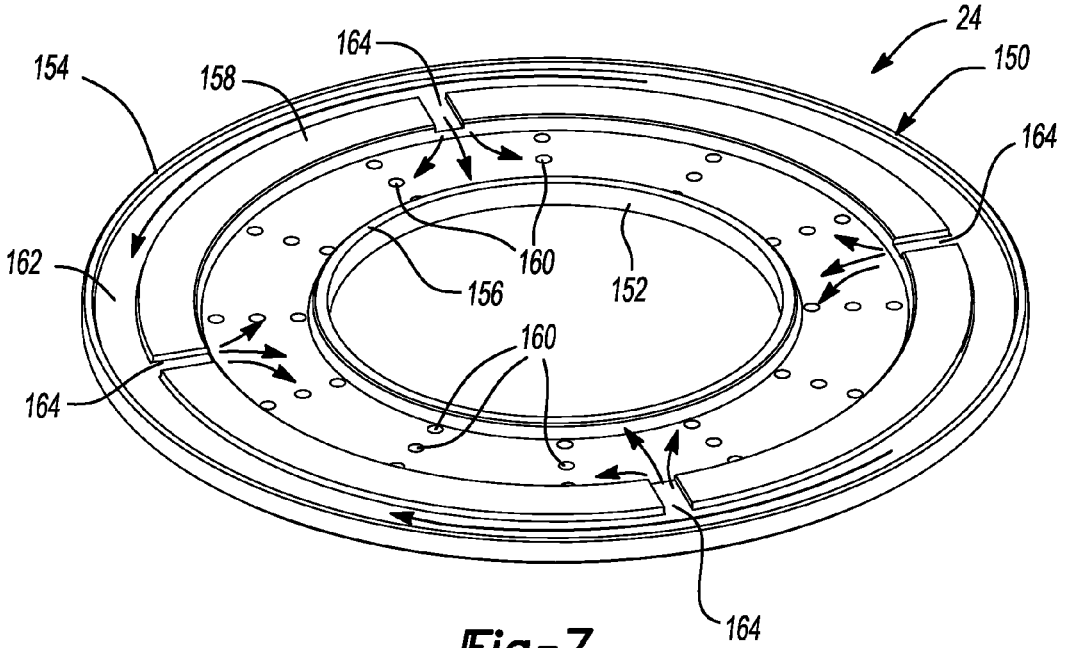
FIG. 7 is a perspective view of an oil distribution member according to the principles of the present disclosure.

With particular reference to FIGS. 3, 6, and 7, the oil distribution member 24 is shown as an annular member disposed above the motor assembly 16 and received in the lower recessed portion 62 of the main-bearing housing 44. The oil distribution member 24 may include a body portion 150 and a central aperture 152. As shown best in FIG. 7, the body portion 150 may include an outer rim 154, an inner rim 156, a raised ring 158, and a plurality of oil-drain holes 160. The oil-drain holes 160 may be disposed between the inner rim 156 and the raised ring 158 and may extend through the body portion 150. The outer rim 154 may cooperate with the raised ring 158 to form an oil-feed groove 162 therebetween. The oil-feed groove 162 may be in fluid communication with the second passage 72 in the main-bearing housing 44 (FIG. 4). The raised ring 158 may include a plurality of oil feed channels 164 through which oil may flow from the oil-feed groove 162 to the plurality of oil-drain holes 160.

Figure 8:
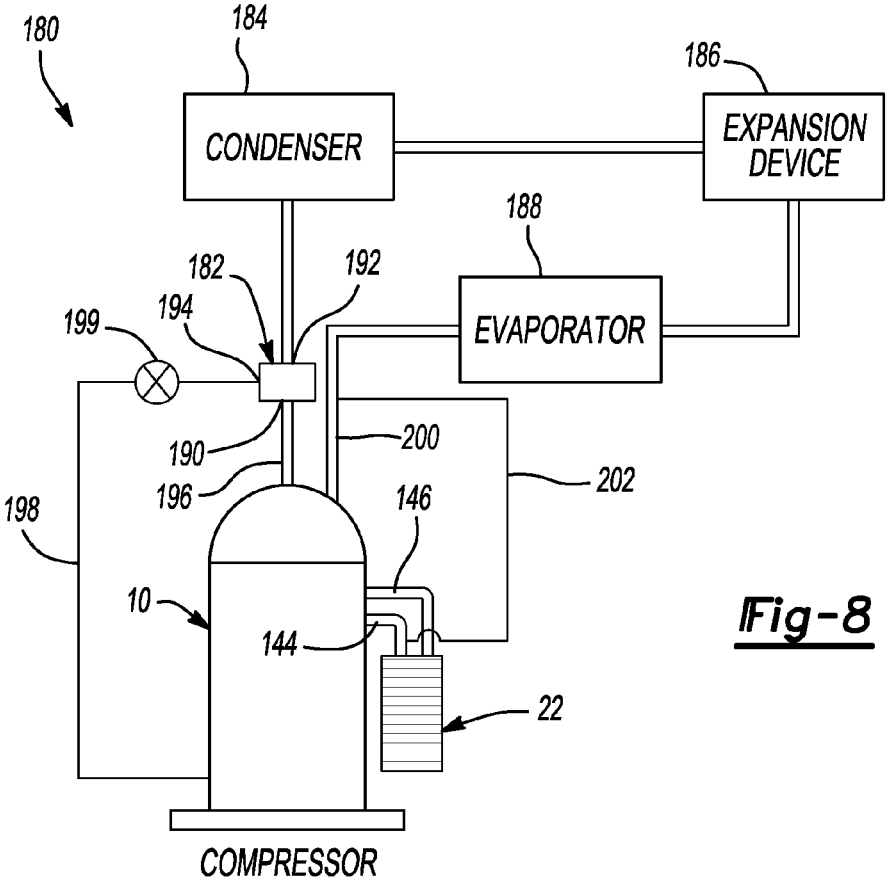
FIG. 8 is a schematic view of the compressor incorporated into a fluid circuit according to the principles of the present disclosure.

As shown in FIG. 8, the compressor 10 may be incorporated into a fluid circuit 180 that may include an oil separator 182, a condenser 184, an expansion device 186, and an evaporator 188. The oil separator 182 may include an inlet 190, a first outlet 192, and a second outlet 194. The inlet 190 may be fluidly coupled with the discharge fitting 30 of the compressor 10 via a discharge line 196. The first outlet 192 of the oil separator 182 may be in fluid communication with the condenser 184. The second outlet 194 of the oil separator 182 may be fluidly coupled to an oil-return line 198 which, in turn, may be in fluid communication with the oil sump 20. A valve 199 may be disposed on the oil-return line 198 and may open and close to allow and restrict fluid communication between the second outlet 194 and the oil sump 20. The evaporator 188 may be in fluid communication with the suction fitting 34 via a suction line 200. An oil-injection line 202 may provide fluid communication between the suction line 200 and the first conduit 144 and/or the second conduit 146 of the heat exchanger 22.

With continued reference to FIGS. 1-8, operation of the compressor 10 and the fluid circuit 180 will be described in detail. The compressor 10 circulates a working fluid, such as a refrigerant or carbon dioxide, for example, throughout the fluid circuit 180. Heat from the high-pressure working fluid is rejected to the environment at the condenser 184. From the condenser 184, the working fluid flows through the expansion device 186, which reduces the pressure of the working fluid and further decreases its temperature. From the expansion device 186, the working fluid flows to the evaporator 188, where the working fluid absorbs heat from ambient air.

From the evaporator 188, suction-pressure working fluid flows through the suction line 200 toward the compressor 10. Oil from the first and/or second conduits 144, 146 of the heat exchanger 22 may be injected into the suction-pressure working fluid in the suction line 200 via the oil-injection line 202.

The suction-pressure working fluid in the suction line 200 and and the oil injected into the suction line 200 flows through the suction fitting 34 and into the compression mechanism 18 via the suction passage 136. The compression mechanism 18 compresses the working fluid to a discharge pressure and discharges the fluid from the shell assembly 12 through the discharge passage 134 and the discharge fitting 30.

From the discharge fitting 30, the working fluid enters the inlet 190 of the oil separator 182. The oil separator 182 separates a majority of the oil from the working fluid in the discharge line 196. The working fluid flows through the first outlet 192 toward the condenser 184, while the oil may exit the oil separator 182 through the second outlet 194. The valve 199 may open to allow a predetermined amount of oil to flow through the oil-return line 198 to the oil sump 20 when the oil disposed within the oil separator reaches a predetermined level.

As described above, a substantial portion of the suction-pressure fluid entering the compressor 10 is fluidly isolated from the motor assembly 16 and the heat associated with the internal cavity of the shell assembly 12, which improves the volumetric efficiency of the compressor 10. Such heat is generated by operation of the motor assembly 16 and friction from various moving components within the compressor 10. During such operation, oil from the oil sump 20 may be pumped through the heat exchanger 22 and delivered to the motor assembly 16 via the oil distribution member 24 to cool the motor assembly 16, which will be described in further detail below.

As the drive shaft 80 rotates during operation of the compressor 10, oil in the oil sump 20 may be pumped or drawn into the concentric bore 104 of the drive shaft 80 and up through the eccentric bore 106. The oil may spill out of the eccentric bore 106 and over the distal end of the drive shaft 80 into the counterweight cavity 68. Rotation of the upper counterweight 102 within the counterweight cavity 68 may pump the oil into the first passage 70 in the main-bearing housing 44 (FIG. 3), through the first passage 92 in the motor housing 74, through the first oil fitting 38, and into the heat exchanger 22 via the first conduit 144. The oil may flow through the coil of the heat exchanger 22 under force of the rotating upper counterweight 102, where heat may be rejected from the oil to ambient air.

Upon exiting the coil of the heat exchanger 22 though the outlet 142 (FIG. 4), the oil may flow through the second conduit 146, through the second oil fitting 39, through the second passage 94 of the motor housing 74 and through the second passage 72 of the main-bearing housing 44. From the second passage 72, the oil may flow into the oil-feed groove 162 of the oil distribution member 24. Oil may then flow throughout the oil-feed groove 162 and enter any of the plurality of oil feed channels 164. From the oil feed channels 164, the oil may flow into the plurality of oil-drain holes 160.

As described above, the oil-drain holes 160 extend through the oil distribution member 24 such that oil entering the oil-drain holes 160 will drip and/or flow onto the stator 76 and/or rotor 78 of the motor assembly 16. Because the oil dripping and/or flowing onto the stator 76, rotor 78, and/or other components of the motor assembly 16 has been cooled in the heat exchanger 22, the oil is effective in cooling the stator 76, rotor 78, and/or other components of the motor assembly 16. In this manner, the oil prevents the motor assembly 16 from overheating, thereby improving the performance of the motor assembly 16 and increasing its operational lifetime.

The oil may drip and/or flow down the motor assembly 16 toward the bottom of the internal cavity 84 of the motor housing 74. The oil may exit the internal cavity 84 of the motor housing 74 through any of the openings 96 and/or the lower central aperture 86 and return to the oil sump 20.

Figure 9:
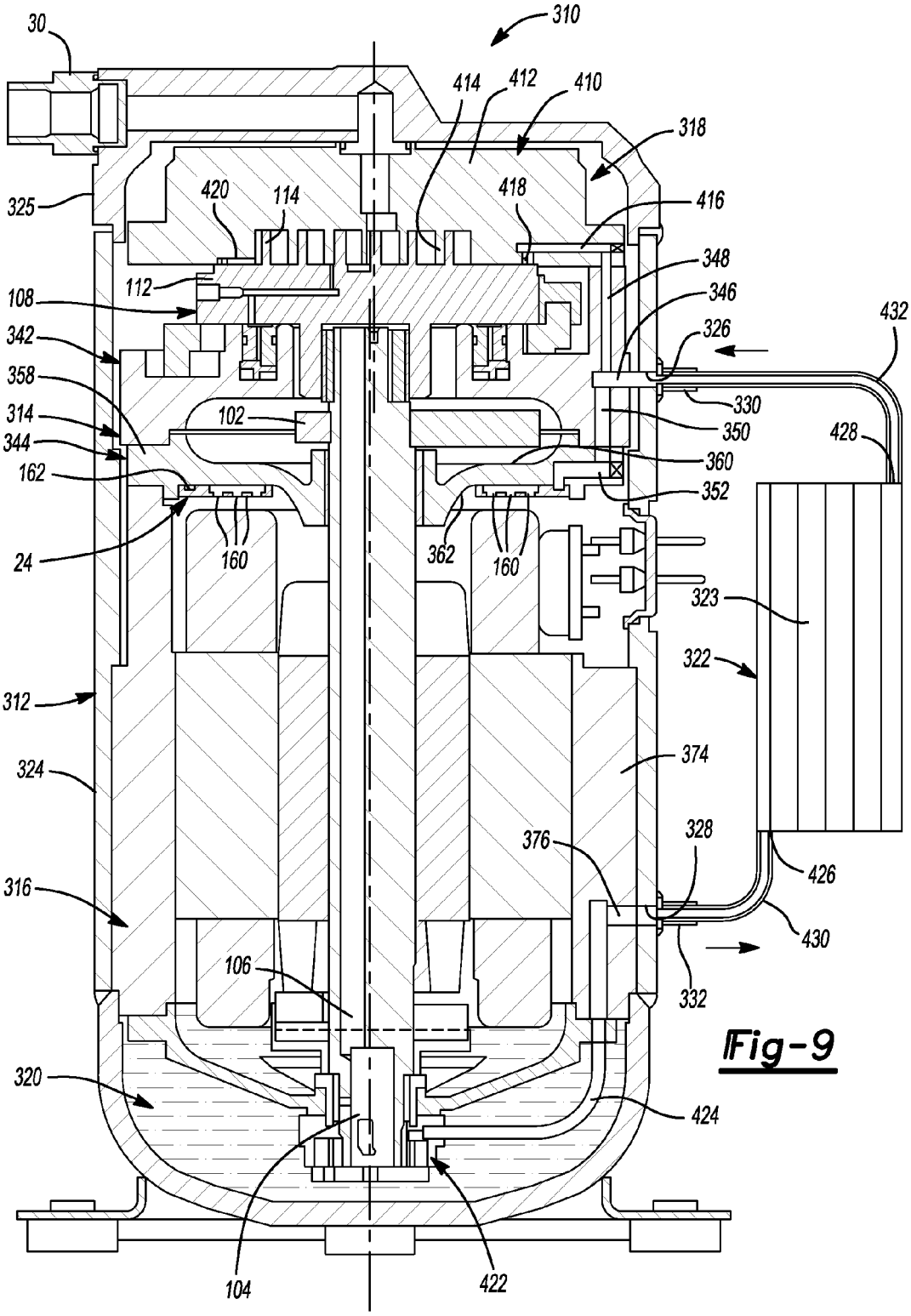
FIG. 9 is a cross-sectional view of a compressor according to the principles of the present disclosure.
Figure 10:
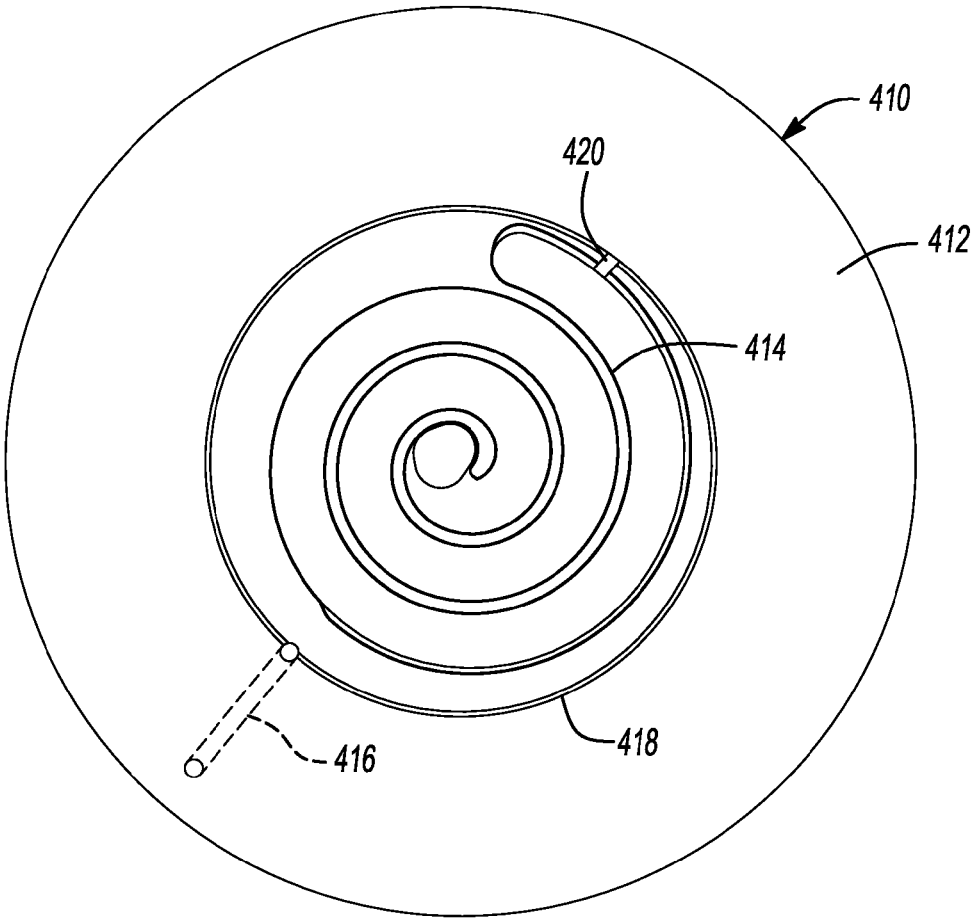
FIG. 10 is a plan view of a scroll member of the compressor of FIG. 9.

With reference to FIGS. 9 and 10, a compressor 310 is provided. The structure and function of many of the components associated with the compressor 310 may be substantially similar in structure and function to many of the components of the compressor 10. Therefore, such components will not be described again in detail. Like reference numerals are used hereinafter and in the drawings to identify like components described above. The compressor 310 may include a shell assembly 312, a bearing housing assembly 314, a motor assembly 316, a compression mechanism 318, an oil sump 320, a heat exchanger 322, and the oil distribution member 24 (described above). Like the compressor 10, the compressor 310 may be incorporated into the fluid circuit 180 described above and shown in FIG. 8. It will be appreciated that the oil-injection line 202 shown in FIG. 8 may not be needed when the compressor 310 is incorporated into the fluid circuit 180.

The shell assembly 312 may include a generally cylindrical shell 324 and an end cap 325. The shell 324 may include a first opening 326 and a second opening 328. A first oil fitting 330 may engage the first opening 326, and a second oil fitting 332 may engage the second opening 328.

The bearing housing assembly 314 may include a thrust-bearing housing 342 and a main-bearing housing 344. The thrust-bearing housing 342 may include an inlet passage 346, a first distribution passage 348, and a second distribution passage 350. The inlet passage 346 may extend radially into an outer portion of the thrust-bearing housing 342 and may be in fluid communication with the first oil fitting 330. The first and second distribution passages 348, 350 may be in fluid communication with the inlet passage 346 and may extend in opposite axial directions from the inlet passage 346. The first distribution passage 348 may have a smaller diameter than that of the second distribution passage 350.

The main-bearing housing 344 may include an outer portion 358, an upper recessed portion 360, and a lower recessed portion 362. A passage 352 may extend through the outer portion 358 and through to the lower recessed portion 362 and may be in fluid communication with the second distribution passage 350 and the oil-feed groove 162 of the oil distribution member 24.

The motor assembly 316 may include a stator housing 374, the stator 76, and the rotor 78, and may selectively rotate the drive shaft 80. The stator housing 374 may engage the shell assembly 312 and may include a generally L-shaped oil passage 376 extending through a portion thereof and in fluid communication with the second oil fitting 332.

The compression mechanism 318 includes the orbiting scroll member 108 and a non-orbiting scroll member 410. As described above, the orbiting scroll member 108 includes the end plate 112 and the spiral wrap 114 extending therefrom. The non-orbiting scroll member 410 may include and end plate 412, a spiral wrap 414, an oil-supply passage 416, an oil groove 418, and an oil-injection passage 420. The spiral wrap 414 meshingly engages the spiral wrap 114 of the orbiting scroll member 108 to form moving fluid pockets between the orbiting scroll member 108 and non-orbiting scroll member 410.

The oil-supply passage 416 may extend radially through a portion of an end plate 412 of the non-orbiting scroll member 410 and may be in fluid communication with the first distribution passage 348 of the thrust-bearing housing 342. The oil groove 418 may be a generally annular groove extending circumferentially around the spiral wrap 414 and may be in fluid communication with the oil-supply passage 416 and the oil-injection passage 420. The oil-injection passage 420 may be in fluid communication with a radially outer one of the moving fluid pockets defined by the spiral wraps 114, 414.

The oil sump 320 may be defined by a lower portion of the shell assembly 312 and may contain a volume of a lubricant, such as oil, for example. An oil pump 422 may be disposed in the oil sump 320 and may be attached to a lower end of the drive shaft 80. The oil pump 422 may be fluidly coupled with the oil passage 376 of the stator housing 374 via a first conduit 424.

The heat exchanger 322 may include a coil 323 having an inlet 426 and an outlet 428. An inlet conduit 430 may be in fluid communication with the second oil fitting 332 and the inlet 426 while an outlet conduit 432 may be in fluid communication with the outlet 428 and the first oil fitting 330.

With continued reference to FIGS. 9 and 10, operation of the compressor 310 will be described in detail. As described above, suction-pressure working fluid may enter the compressor 310 directly from the suction fitting 34 (FIG. 6) and enter the compression mechanism 318 while maintaining substantial fluid isolation from the internal cavity of the shell assembly 312. Such an arrangement reduces preheating of the working fluid, which improves the volumetric efficiency of the compressor 310.

During operation of the motor assembly 316, the oil pump 422 may pump oil from the oil sump 320 into the first conduit 424. From the first conduit 424, the oil may flow through the oil passage 376 in the stator housing 374 and exit the shell assembly 312 through the second oil fitting 332. From the second oil fitting 332, the oil may flow into the inlet 426 of the heat exchanger 322 via the inlet conduit 430.

Oil flowing through the heat exchanger 322 may reject heat to ambient air before exiting the heat exchanger 322 through the outlet 428 and flowing into the outlet conduit 432. From the outlet conduit 432, the oil may enter the shell assembly 312 via the first oil fitting 330. From the first oil fitting 330, the oil may flow through the inlet passage 346 in the thrust-bearing housing 342. From the inlet passage 346 a first portion of the oil flowing therethrough may enter the first distribution passage 348 and a second portion of the oil flowing through the inlet passage 346 may enter the second distribution passage 350.

The oil flowing from the inlet passage 346 to the first distribution passage 348 may enter the oil-supply passage 416 of the non-orbiting scroll member 410. From the oil-supply passage 416, the oil may enter the oil groove 418. A first portion of the oil disposed in the oil groove 418 may leak between the end plates 112, 412 of the orbiting and non-orbiting scrolls, respectively. A second portion of the oil disposed in the oil groove 418 may enter the oil-injection passage 420 and flow into one of the moving fluid pockets of the compression mechanism 318. In this manner, the oil maintains adequate lubrication between the orbiting and non-orbiting scrolls 108, 410 and reduces friction therebetween to facilitate robust sealing of the moving fluid pockets.

The second portion of oil flowing from the inlet passage 346 to the second distribution passage 350 may enter the passage 352 extending through the main-bearing housing 344. From the passage 352, oil may flow into the oil-feed groove 162 of the oil distribution member 24, as described above with reference to the compressor 10. Oil may flow throughout the oil-feed groove 162 of the oil distribution member 24 and may enter any of the plurality of oil feed channels 164. From the oil feed channels 164, the oil may flow into the plurality of oil-drain holes 160. As described above, the oil-drain holes 160 extend through the oil distribution member 24 such that oil entering the oil-drain holes 160 will drip and/or flow onto the stator 76 and/or rotor 78 of the motor assembly 316. The oil will drip and/or flow down the motor assembly 316 toward the bottom of the stator housing 374 and back into the oil sump 320 to cool the motor assembly 316.

Because the oil dripping and/or flowing onto the stator 76, rotor 78, and/or other components of the motor assembly 316 has been cooled in the heat exchanger 322, the oil is effective in cooling the stator 76, rotor 78, and/or other components of the motor assembly 16. In this manner, the oil prevents the motor assembly 16 from overheating, thereby improving the performance of the motor assembly 16 and increasing its operational lifetime.

Figure 11:
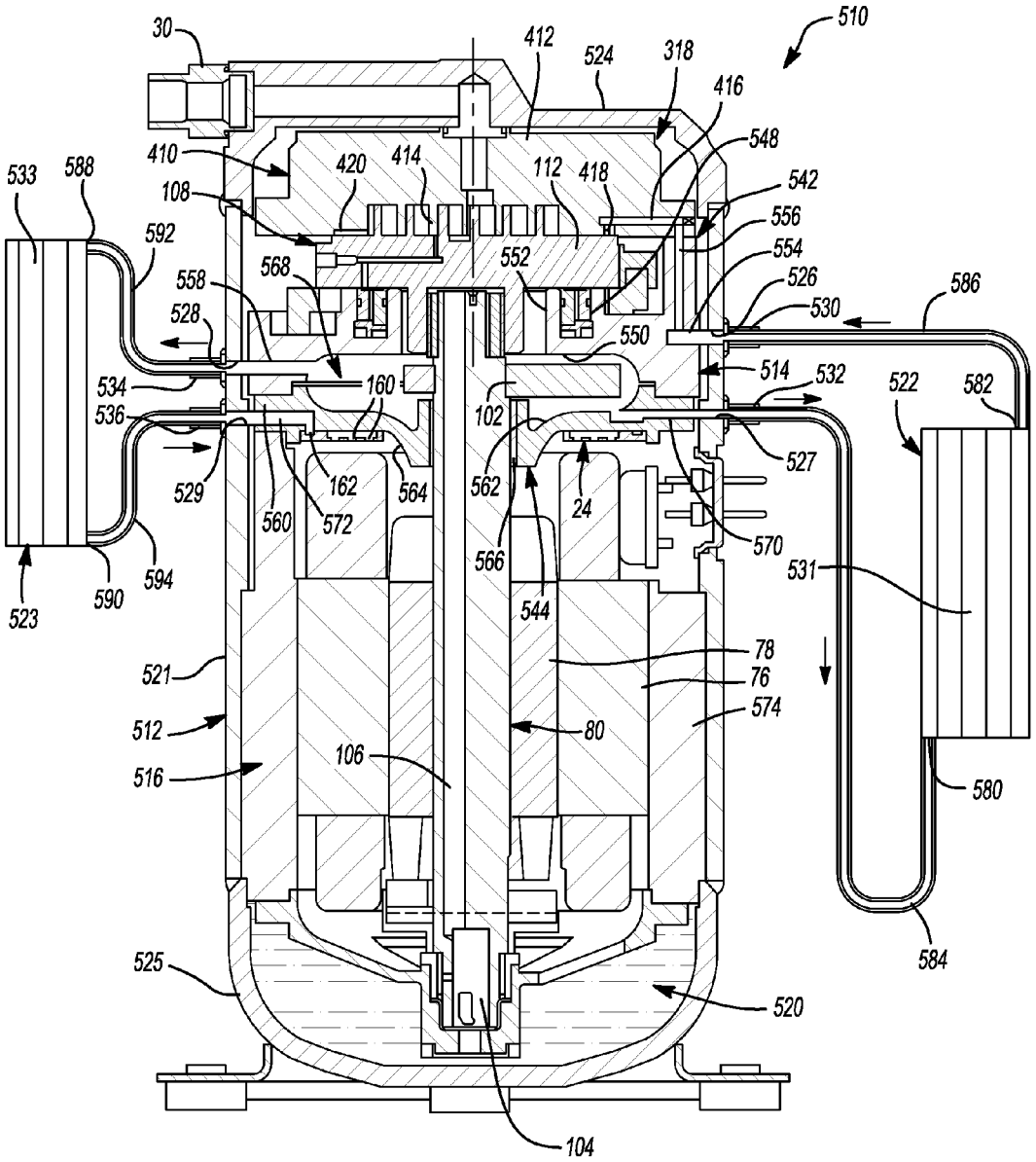
FIG. 11 is a cross-sectional view of a compressor according to the principles of the present disclosure.

Referring now to FIGS. 10 and 11, a compressor 510 is provided. The structure and function of many of the components associated with the compressor 510 may be substantially similar in structure and function to many of the components of the compressor 10 and/or the compressor 310. Therefore, such components will not be described again in detail. Like reference numerals are used hereinafter and in the drawings to identify like components described above. The compressor 510 may include a shell assembly 512, a bearing-housing assembly 514, a motor assembly 516, the compression mechanism 318 (described above), an oil sump 520, a first heat exchanger 522, a second heat exchanger 523, and the oil distribution member 24 (described above). Like the compressors 10, 310, the compressor 510 may be incorporated into the fluid circuit 180 described above and shown in FIG. 8. It will be appreciated that the oil-injection line 202 shown in FIG. 8 may not be needed when the compressor 510 is incorporated into the fluid circuit 180.

The shell assembly 512 may include a generally cylindrical shell 521, an end cap 524, and a lower portion 525. The shell 521 may include a first opening 526, a second opening 527, a third opening 528, and a fourth opening 529. A first oil fitting 530 may engage the first opening 526 for fluid communication therebetween, a second oil fitting 532 may engage the second opening 527 for fluid communication therebetween, a third oil fitting 534 may engage the third opening 528 for fluid communication therebetween, and a fourth oil fitting 536 may engage the fourth opening 529 for fluid communication therebetween.

The bearing-housing assembly 514 may include a thrust-bearing housing 542 and a main-bearing housing 544. The thrust bearing housing 542 may include an upper recessed portion 548, a lower recessed portion 550, a central aperture 552, a first radial passage 554, an axial passage 556, and a second radial passage 558. The first radial passage 554 may extend radially through a first side of the thrust bearing housing 542 and may be in fluid communication with the first oil fitting 530 and the axial passage 556. The axial passage 556 may be in fluid communication with the oil-supply passage 416 in the non-orbiting scroll member 410. The second radial passage 558 may extend radially from a second side of the thrust bearing housing 542 through to the lower recessed portion 550 and may be in fluid communication with the third oil fitting 534.

The main-bearing housing 544 may include an outer rim 560, an upper recessed portion 562, a lower recessed portion 564, and a main bearing 566. The outer rim 560 may abut the thrust-bearing housing 542. The upper recessed portion 562 of the main-bearing housing 544 and the lower recessed portion 550 of the thrust-bearing housing 542 may cooperate to define a counterweight cavity 568 in fluid communication with the second radial passage 558 of the thrust-bearing housing 542. A first passage 570 may extend through a first side of the outer rim 560 of the main-bearing housing 544 to the upper recessed portion 562 of the main-bearing housing 544 and may be in fluid communication with the second oil fitting 532 and the counterweight cavity 568. A second passage 572 may extend through a second side of the outer rim 560 of the main-bearing housing 544 to the lower recessed portion 564 of the main-bearing housing 544 and may be in fluid communication with the fourth oil fitting 536 and the oil distribution member 24.

The motor assembly 516 may include a stator housing 574, the stator 76, and the rotor 78 that cooperate to rotate the drive shaft 80. The stator housing 574 may engage the shell assembly 512 and the main-bearing housing 544. As described above, the drive shaft 80 may include the upper counterweight 102, the concentric bore 104, and the eccentric bore 106. The upper counterweight 102 is fixed to the drive shaft 80 at a location proximate to the crank pin 100 and rotates within the counterweight cavity 568. The concentric bore 104 may be in fluid communication with the eccentric bore 106 and the oil sump 520.

The oil sump 520 may be at least partially defined by a lower portion 525 of the shell assembly 512. The oil sump 520 may be filled with a lubricant, such as oil, for example, to a predetermined level. The concentric bore 104 and eccentric bore 106 of the drive shaft 80 are in fluid communication with the oil sump 520 such that rotation of the drive shaft 80 pumps or draws oil from the oil sump 520, through the concentric bore 104, and along the eccentric bore 106, and to the compression mechanism 318 and various other components of the compressor 510 that require lubrication and cooling.

The first heat exchanger 522 may include a coil 531 having an inlet 580 and an outlet 582. An inlet conduit 584 may be in fluid communication with the second oil fitting 532 and the inlet 580. An outlet conduit 586 may be in fluid communication with the outlet 582 and the first oil fitting 530.

The second heat exchanger 523 may include a coil 533 having an inlet 588 and an outlet 590. An inlet conduit 592 may be in fluid communication with the third oil fitting 534 and the inlet 588 while an outlet conduit 594 may be in fluid communication with the outlet 590 and the fourth oil fitting 536.

With continued reference to FIGS. 10 and 11, operation of the compressor 510 will be described in detail. As described above, suction-pressure working fluid may enter the compressor 510 through the suction fitting 34 and may enter the compression mechanism 318 while maintaining substantial fluid isolation from the internal cavity of the shell assembly 512. While this reduces preheating of the working fluid, which improves volumetric efficiency of the compressor 510, such an arrangement may hinder cooling the motor assembly 516.

As the drive shaft 80 rotates during operation of the compressor 510, oil in the oil sump 520 may be pumped into the concentric bore 104 of the drive shaft 80 and up through the eccentric bore 106. The oil may spill out of the eccentric bore 106 and over the distal end of the drive shaft 80 into the counterweight cavity 568. Rotation of the upper counterweight 102 within the counterweight cavity 568 may pump a first portion of the oil in the counterweight cavity 568 into the first passage 570 in the main-bearing housing 544 and a second portion of the oil in the counterweight cavity 568 into the second radial passage 558 in the thrust-bearing housing 542.

The first portion of the oil disposed in the counterweight cavity 568 may flow through the first passage 570 in the main-bearing housing 544, through the second oil fitting 532, and into the first heat exchanger 522 via the inlet conduit 584. The oil may flow through the coil of the first heat exchanger 522, where heat may be rejected from the oil to ambient air. The oil may exit the first heat exchanger 522 through the outlet 582 and flow into the outlet conduit 586. From the outlet conduit 586, the oil may enter the shell assembly 512 via the first oil fitting 530. From the first oil fitting 530, the oil may flow through the first radial passage 554 in the thrust-bearing housing 542, through the axial passage 556 and into the oil-supply passage 416 in the non-orbiting scroll member 410.

From the oil-supply passage 416, the oil may enter the oil groove 418. As described above, a first portion of the oil in the oil groove 418 may leak between the end plates 112, 412 of the orbiting and non-orbiting scrolls, respectively. A second portion of the oil in the oil groove 418 may enter the oil-injection passage 420 and flow into one of the moving fluid pockets of the compression mechanism 318. In this manner, the oil provides lubrication between the orbiting and non-orbiting scrolls 108, 410 to reduce friction therebetween and facilitate robust sealing of the moving fluid pockets.

The second portion of the oil disposed in the counterweight cavity 568 may flow through the second radial passage 558 in the thrust-bearing housing 542, through the third oil fitting 534, and into the second heat exchanger 523 via the inlet conduit 592. The oil may flow through the coil of the second heat exchanger 523, where heat may be rejected from the oil to ambient air. The oil may exit the second heat exchanger 523 through the outlet 590 and flow into the outlet conduit 594. From the outlet conduit 594, the oil may enter the shell assembly 512 via the fourth oil fitting 536. From the fourth oil fitting 536, the oil may flow through the second passage 572 extending through the main-bearing housing 544.

From the second passage 572, the oil may flow into the oil-feed groove 162 of the oil distribution member 24, as described above with reference to the compressors 10, 310.

Oil may flow around throughout the oil-feed groove 162 of the oil distribution member 24 and enter any of the plurality of oil feed channels 164. From the oil feed channels 164, the oil may flow into the plurality of oil-drain holes 160. As described above, the oil-drain holes 160 extend through the oil distribution member 24 such that oil entering the oil-drain holes 160 will drip and/or flow onto the stator 76 and/or rotor 78 of the motor assembly 516. The oil will drip and/or flow down the motor assembly 516 toward the bottom of the stator housing 574 and back into the oil sump 520.

Because the oil dripping and/or flowing onto the stator 76, rotor 78, and/or other components of the motor assembly 516 has been cooled in the second heat exchanger 523, the oil is effective in cooling the stator 76, rotor 78, and/or other components of the motor assembly 516. In this manner, the oil prevents the motor assembly 516 from overheating, thereby improving the performance of the motor assembly 516 and increasing its operational lifetime. Furthermore, incorporating multiple heat exchangers 522, 523 into the compressor 510 may increase the capacity to cool the oil relative to a compressor having a single heat exchanger.

While the compressors 10, 510 are described above as utilizing the rotation of the upper counterweight 102 within the counterweight cavity 68, 568, respectively, to pump oil into the heat exchangers 22, 522, 523, the compressors 10, 510 may additionally or alternatively include other pumping mechanisms to force the oil through the heat exchangers 22, 522, 523.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A compressor comprising:

a shell defining an internal cavity and an oil sump;

a compression mechanism disposed within said shell;

a motor coupled to a driveshaft for selectively powering said compression mechanism, said drive shaft includes a first end disposed proximate to said oil sump and a second end disposed proximate to said compression mechanism, said drive shaft operable to transport said oil from said oil sump to said second end;

a pumping mechanism in fluid-pumping communication with said oil sump; and a first heat exchanger disposed external from said shell and in fluid communication with said pumping mechanism, said first heat exchanger cooling said oil prior to returning said cooled oil to said internal cavity;

a bearing housing supporting said driveshaft and defining a counterweight cavity; and a counterweight fixed to said driveshaft proximate to said second end, said counterweight is rotatably received within said counterweight cavity, wherein said counterweight cooperates with said counterweight cavity to pump oil received from said oil sump to direct said oil into said first heat exchanger, wherein said bearing housing includes a lubricant inlet and a lubricant outlet extending radially outward from said counterweight cavity, said first heat exchanger receiving lubricant from said lubricant outlet and providing cooled lubricant to said lubricant inlet.

2. The compressor of claim 1, further comprising first and second conduits, said first conduit in fluid communication with said pumping mechanism at a first end and in fluid communication with said first heat exchanger at a second end, said second conduit in fluid communication with said first heat exchanger at a first end and in fluid communication with said internal cavity at a second end.

3. The compressor of claim 1, wherein said counterweight cavity is at least partially formed in a main bearing housing.

4. The compressor of claim 1, further comprising a second heat exchanger in fluid communication with said counterweight cavity.

5. The compressor of claim 1, further comprising an oil distribution member receiving oil from said first heat exchanger and distributing said cooled oil within said internal cavity.

6. The compressor of claim 5, wherein at least a portion of said cooled oil is directed toward said motor.

7. The compressor of claim 1, wherein said compression mechanism includes a non-orbiting scroll member in meshing engagement with an orbiting scroll member.

8. The compressor claim 1, further comprising a suction port fluidly coupled with said compression mechanism to fluidly isolate suction-pressure gas entering the compressor from said motor.

9. The compressor of claim 1, further comprising a conduit in fluid communication with a discharge port at a first end and in fluid communication with said internal cavity at a second end to divert oil disposed within said discharge port to said oil sump.

10. The compressor of claim 9, further comprising an oil separator operable to separate discharge-pressure gas from said oil, said separated oil delivered to said return line of said first heat exchanger via said conduit.

11. The compressor of claim 9, further comprising a valve disposed on said conduit and operable to control an amount of oil directed to said return line of said first heat exchanger via said conduit.

12. The compressor of claim 1, wherein said compression mechanism include first and second compression members, and wherein at least one of said first and second compression members includes a lubricant groove in fluid communication with said first heat exchanger.

13. A compressor comprising:

a shell defining an internal cavity and an oil sump;

a compression mechanism disposed within said shell;

a motor coupled to a driveshaft for selectively powering said compression mechanism;

a pumping mechanism in fluid-pumping communication with said oil sump; and a first heat exchanger disposed external from said shell and in fluid communication with said pumping mechanism, said first heat exchanger cooling said oil prior to returning said cooled oil to said internal cavity;

a suction port fluidly coupled with said compression mechanism to fluidly isolate suction-pressure gas entering the compressor from said motor;

a first conduit in fluid communication with said pumping mechanism at a first end and in fluid communication with said first heat exchanger at a second end; and a second conduit fluidly coupled at one end with said first conduit upstream of said first heat exchanger and fluidly coupled at another end with said suction port to inject oil into a flow of suction-pressure working fluid.

14. The compressor of claim 13, further comprising a lubricant distribution member in fluid communication with said first heat exchanger and operable to distribute said cooled oil within said shell, wherein said distribution member is an annular member including a plurality of lubricant drain apertures extending therethrough.

15. The compressor of claim 13, wherein said compression mechanism include first and second compression members, and wherein at least one of said first and second compression members includes a lubricant groove in fluid communication with said first heat exchanger.

16. The compressor of claim 13, further comprising a counterweight fixed to said driveshaft proximate to said compression mechanism, said counterweight is rotatably received within a counterweight cavity disposed within said internal cavity, wherein said counterweight cooperates with said counterweight cavity to pump oil received from said oil sump to direct said oil into said first heat exchanger.

17. The compressor of claim 16, wherein said counterweight cavity is at least partially formed in a bearing housing that rotatably supports said driveshaft.

18. A compressor comprising:

a shell defining an internal cavity and an oil sump;

a compression mechanism disposed within said shell;

a motor coupled to a driveshaft for selectively powering said compression mechanism;

a bearing housing including a bearing aperture through which said driveshaft extends and a lubricant passage disposed radially outward relative to said bearing aperture;

a pumping mechanism in fluid-pumping communication with said oil sump; and a first heat exchanger disposed external from said shell and in fluid communication with said pumping mechanism, said first heat exchanger cooling said oil prior to returning said cooled oil to said internal cavity;

a lubricant distribution member mounted to said bearing housing such that said distribution member is disposed axially between said bearing housing and said motor, said distribution member in fluid communication with said heat exchanger and said lubricant passage in said bearing housing and operable to distribute said cooled lubricant within said shell, wherein said distribution member is an annular member including a plurality of lubricant drain apertures extending therethrough, said lubricant drain apertures are disposed radially outward relative to a central aperture in said distribution member through which said driveshaft extends, said lubricant drain apertures extend axially through an axial end of said distribution member, said axial end facing said motor.

19. The compressor of claim 18, wherein said drive shaft includes a first end disposed proximate to said oil sump and a second end disposed proximate to said compression mechanism, said drive shaft operable to transport said oil from said oil sump to said second end.

20. The compressor of claim 19, further comprising a counterweight fixed to said driveshaft proximate to said second end.

21. The compressor of claim 20, wherein said counterweight is rotatably received within a counterweight cavity disposed within said internal cavity.

22. The compressor of claim 21, wherein said counterweight cooperates with said counterweight cavity to pump oil received from said oil sump to direct said oil into said first heat exchanger.

23. The compressor of claim 18, wherein said distribution member is an annular member including an inner rim, an outer rim, a raised ring and a plurality of lubricant drain apertures, said raised ring is disposed radially between the inner and outer rims, said inner rim defining said central aperture in said distribution member through which said driveshaft extends, said outer rim and said raised ring defining an annular oil-feed groove therebetween that receives oil from said lubricant passage in said bearing housing, said raised ring including a plurality of oil-feed channels providing fluid communication between said oil-feed groove and said lubricant drain apertures, said lubricant drain apertures are disposed radially between said inner rim and said raised ring and extend axially through an axial end of said distribution member, said axial end of said distribution member facing said motor.

24. A compressor comprising:

a shell defining an internal cavity and an oil sump;

a compression mechanism disposed within said shell;

a motor coupled to a driveshaft for selectively powering said compression mechanism, said drive shaft having a counterweight;

a pumping mechanism in fluid-pumping communication with said oil sump; and a first heat exchanger disposed external from said shell and in fluid communication with said pumping mechanism, said first heat exchanger cooling said oil prior to returning said cooled oil to said internal cavity;

a second heat exchanger receiving lubricant from said pumping mechanism, cooling said lubricant, and returning said cooled lubricant to said shell; and a bearing housing defining a counterweight cavity in which said counterweight rotates, said counterweight cavity having first and second lubricant outlets extending radially outward through said bearing housing, said first and second heat exchangers receiving lubricant from said first and second lubricant outlets.

25. The compressor of claim 24, wherein said compression mechanism include first and second compression members, and wherein at least one of said first and second compression members includes a lubricant groove in fluid communication with said first heat exchanger.

26. The compressor of claim 24, further comprising a lubricant distribution member in fluid communication with one of said first and second heat exchangers and operable to distribute said cooled lubricant within said shell.

27. The compressor of claim 26, wherein said distribution member is an annular member including a plurality of lubricant drain apertures extending therethrough.

* * * * *